US006899478B1

(12) United States Patent
Mucelli et al.

(10) Patent No.: US 6,899,478 B1
(45) Date of Patent: May 31, 2005

(54) METHOD AND MACHINE FOR CARD COLOR PRINTING

(75) Inventors: Alberto Mucelli, Bologna (IT); Marco Mazzanti, Bologna (IT); Franco Salcuni, Ferrara (IT); Antonio Armellin, Calderara di Reno (IT)

(73) Assignee: CIM USA, Inc., Miami, FL (US)

( * ) Notice: Subject to any disclaimer, the term of this patent is extended or adjusted under 35 U.S.C. 154(b) by 39 days.

(21) Appl. No.: 10/467,469

(22) PCT Filed: Aug. 8, 2002

(86) PCT No.: PCT/US02/24992

§ 371 (c)(1),
(2), (4) Date: Aug. 8, 2003

(87) PCT Pub. No.: WO2004/019153

PCT Pub. Date: Mar. 4, 2004

(51) Int. Cl.[7] ..... B41J 2/38; B41J 2/325; B41J 35/16

(52) U.S. Cl. ..... 400/105; 400/120.08; 400/120.15; 400/191; 347/178; 347/186; 235/449

(58) Field of Search ..... 400/73, 76, 104, 400/105, 120.08, 120.15, 191, 521; 347/171, 347/172, 177, 178, 185, 186, 218, 221; 235/380, 235/381, 382, 449

(56) References Cited

U.S. PATENT DOCUMENTS

| | | | | |
|---|---|---|---|---|
| 5,229,586 | A * | 7/1993 | Ishii | 235/375 |
| 5,326,179 | A * | 7/1994 | Fukai et al. | 400/521 |
| 5,486,057 | A | 1/1996 | Skinner et al. | |
| 5,625,399 | A * | 4/1997 | Wiklof et al. | 347/195 |
| 5,685,657 | A * | 11/1997 | Jablonski | 400/635 |
| 5,768,143 | A * | 6/1998 | Fujimoto | 700/235 |
| 5,833,375 | A * | 11/1998 | Gauthier et al. | 400/82 |
| 5,873,664 | A * | 2/1999 | Umemo | 400/579 |
| 5,941,522 | A | 8/1999 | Hagstrom et al. | |
| 6,034,705 | A * | 3/2000 | Tolle et al. | 347/195 |
| 6,064,413 | A * | 5/2000 | Fukui et al. | 347/171 |
| 6,394,344 | B1 * | 5/2002 | Katsumura et al. | 235/380 |
| 6,448,991 | B1 * | 9/2002 | Doan | 347/178 |
| 6,508,399 | B2 * | 1/2003 | Sasaki et al. | 235/381 |
| 2002/0069383 | A1 * | 6/2002 | Ni | 714/720 |

FOREIGN PATENT DOCUMENTS

| | | |
|---|---|---|
| EP | 0 189 574 A2 | 8/1986 |
| EP | 0299 653 A2 | 1/1989 |
| EP | 0624 480 A2 | 11/1994 |
| FR | 0 573 336 A1 | 12/1993 |
| FR | 2 783 460 | 3/2000 |
| GB | 2 258 550 A | 2/1993 |
| WO | WO 96/06739 | 3/1996 |
| WO | WO 00/16235 | 3/2000 |
| WO | WO 00/34050 | 6/2000 |

* cited by examiner

*Primary Examiner*—Stephen R. Funk
(74) *Attorney, Agent, or Firm*—Dickstein Shapiro Morin & Oshinsky LLP

(57) ABSTRACT

A method for ribbon color thermal printing and encoding cards, particularly pre-paid, smart cards, chip cards, and the like is disclosed. The method includes the steps of detecting the printing ribbon color, controlling the thermal printing energy feed and driving the printing, encoding and detection, in which the encoding is carried out at a location upstream of the thermal printing. The color detection is carried out at a location between the encoding and/or thermal printing, and at the same time as the printing.

14 Claims, 10 Drawing Sheets

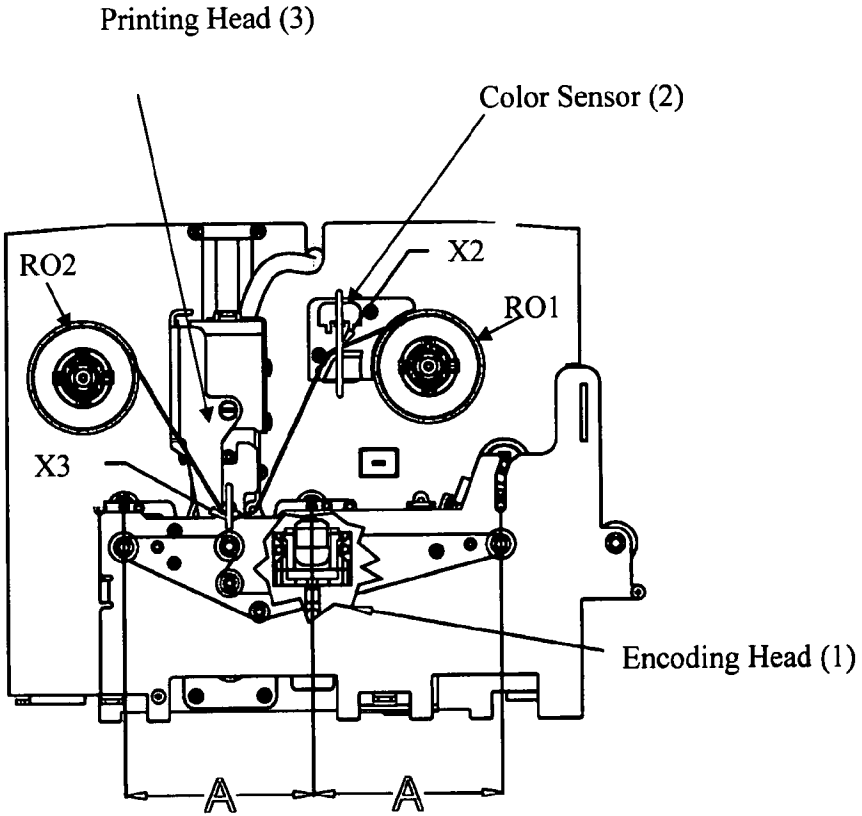
Figure 3
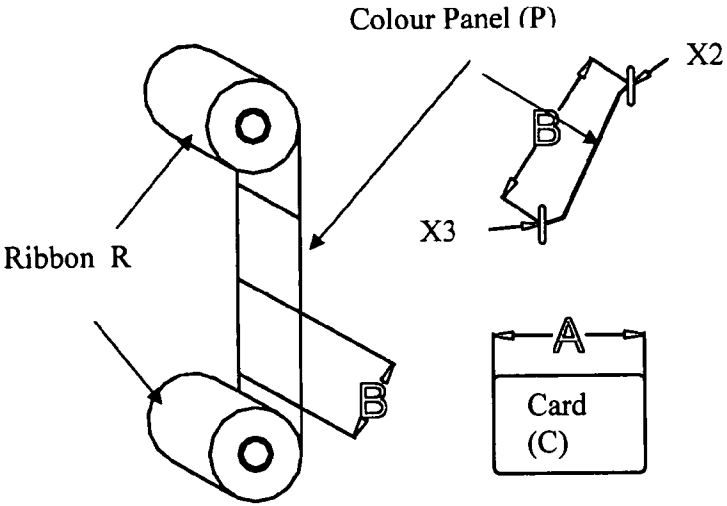
Figure 3A
Figure 3B

| Color Decoding Table | | | |
|---|---|---|---|
| Ribbon | RX #1 | RX #2 | RX #3 |
| YELLOW | HIGH level | HIGH level | LOW level |
| MAGENTA | HIGH level | LOW level | LOW level |
| CYAN | LOW level | LOW level | HIGH level |
| BLACK | LOW level | LOW level | LOW level |
| OVERLAY | HIGH level | HIGH level | HIGH level |

METHOD AND MACHINE FOR CARD COLOR PRINTING

BACKGROUND OF THE INVENTION

The present invention concerns a method for colour printing and magnetic encoding of plastic cards, in particular pre-paid cards, smart cards and the like.

The invention comprises also a compact, reliable, efficient, low-cost machine embodying said method.

There is a huge and fast development and commercial use in every field of the so called smart-cards.

Consequently there has been a parallel development of processes, systems and machines for the plastic cards identification, implementing the different technologies that have been brought about in the last 20 years.

The field of said methods, systems, machines and the like is now-a-day a so-called patent crowded field.

Among the most important aspects of this recent and continuously improving technology we have to emphasize the following:

1) Magnetic Encoding, 2) Thermal Printing, 3) Printing Ribbon Colour Detection, 4) Control of the Heat Energy feed to the Thermal Printing.

About aspect 1), there is a large number of patents, such as WO/0016235 and U.S. Pat. No. 5,941,522 that mostly concern the mechanical complexity of the design of a Plastic Card Printer including a Magnetic Encoder. Generally, however, the encoding is carried out after (downstream along the card path) the Printing, whereby there is the drawback that cards that are printed well may nevertheless be poorly downloaded because they have undergone a bad encoding with a non-negligible card waste.

As to item 2) we limit ourselves to cite U.S. Pat. No. 5,486,057.

European Patent Application Publication n. 0 299 653 A2 concerns a Method and Apparatus for the Thermal Printing and the relevant Thermal Heat feeding.

Several systems and methods for the Ribbon Colour Detection have been proposed and implemented, such as those described in WO 00/34050, EP Publications N. 0189574 A2 and N. 0 624 480 A2 and French Pat. Pub. N. 2 783 460 A1.

UK Patent Application N. 2 258 550 A, International Patent Publication WO 96/06739 and EP Publication 0 573 336 A1, concern the Thermal Printing Control through the control of the Heat feed to the Printing Head.

Moreover, up to now, the overall printing, encoding, colour detecting, and printing thermal control have been managed by an electronic system based on a CPU (Central Processing Unit), that implements for each control aspect a SW (Software) driver which has to execute its function at the same time, all together and in real time.

The computational complexity of all these drivers, executed in multitasking, has required the use of CPUs with increasing performances and resources, which generally are expensive and difficult to manage.

Accordingly, the methods and apparatus described in the Published Patent Literature show, together with several merits, also many decisive and conditioning inconveniences. Just to mention a major drawback, the conventional apparatus must have a longitudinal length of at least four times the major dimension of a card.

First object of the present invention is to provide a general method which eliminates the drawbacks and insufficiencies of the Prior Art, in particular of the Art according to the above mentioned Patents.

Another object of the present invention is to provide a compact, reliable, efficient and low cost machine implementing said method.

SUMMARY OF THE INVENTION

The present invention concerns a method for ribbon colour thermal printing and/or encoding cards particularly pre-paid-, smart-, chip-cards and the like, by detecting the printing ribbon colour, controlling the thermal printing energy feed and driving said printing encoding and detecting.

According to a first feature of the invention, a) said encoding is carried out spacially upstream to said thermal printing and b) detection takes place spacially between said encoding and printing and contemporaneously to said printing.

Typically step a) is carried out by critically coordinating encoding and printing, in particular by encoding at a distance from the printing lower then card major dimension. Characteristically for step b) the detection is positioned in a plane vertically superposed to the plane containing aligned encoding and printing, so to minimize both the length between encoding and printing and the height of the detection over printing.

Advantageously encoding, printing and detection are controlled by hardware (HW) reprogrammable i.e. with FPGA) while the thermal printing is controlled by controlling the thermal energy feed with the aid of a space-time convolution algorithm.

The invention comprises a compact, reliable, efficient and low-cost machine characterized in that along the card path from the card feeder to the card unloader, the encoder is spatially upstream from the thermal printer at a distance not greater than the major dimension of the card; the colour sensor is positioned between said encoder and printer but in a plane superposed to the plane of said encoder and printer containing also the card path line; and the spatial distance between sensor and printer, minimizing both the length and the height of the machine, is equal to the major dimension of the ribbon colour panel.

Further features of the invention are recited in the claims at the end of the specification, which are however considered herein incorporated.

BRIEF DESCRIPTION OF THE DRAWINGS

The various features and advantages of the invention will better appear from the following description of the embodiments represented in the accompanying drawings, in which:

FIG. 3: is a schematic partial front view of an apparatus according to the invention;

FIG. 3A: is a top view of a card C having A as maximal dimension;

FIG. 3B: is a prospective view of a colour ribbon R with three panels P having B as maximum dimension;

FIG. 3C shows the distance B between the center X2 of the sensor 2, in which the ribbon colour detection takes place, and the point X3, corresponding to the Dot line of the Printing Head, B being the maximum dimension of the panels P;

DETAILED DESCRIPTION OF THE PREFERRED EMBODIMENTS

Figure 1:
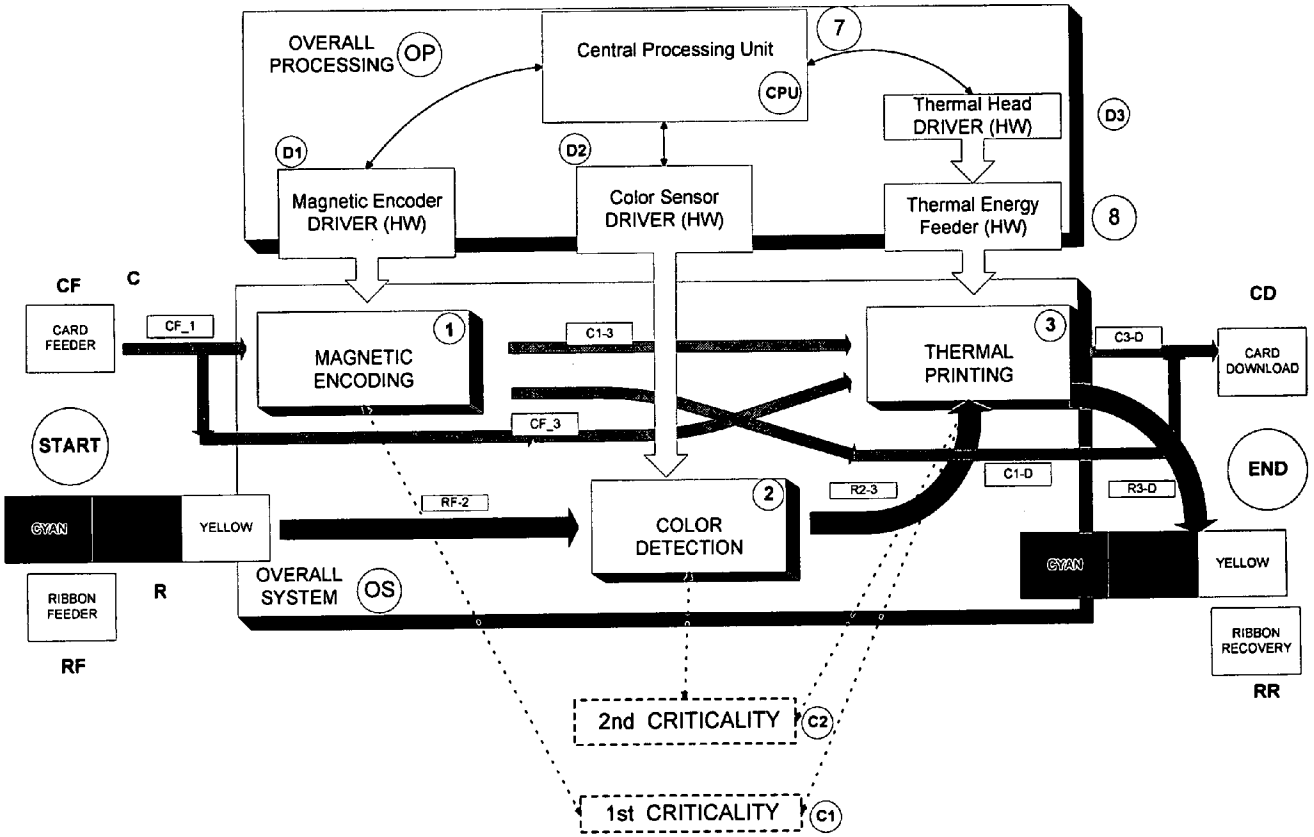
FIG. 1: is a block diagram of the overall system; according to the invention, in which while the Card to be processed (C) undergoes the Magnetic Encoding (1) and the Thermal Printing (3) under critical coordination between said steps of Encoding and Printing, the colour ribbon (R) undergoes the Colour Detection (2) and the Thermal Printing(3) under critical coordination of Detection and Printing. The general system of the invention comprises an overall lower operative block (OS) and an upper overall processing block (OP). In the subsystem OS the card (C) is characteristically submitted firstly to the Magnetic Encoding (1) and secondly to the Thermal Printing (3) while the Ribbon (R) is submitted to Colour Detection (2) and to the Thermal Printing (3).

The first feature of the invention is that the encoding (1) is upstream the printing (3) with which is spacially aligned while the colour detection (2) is in the space between said encoding and printing but in a plane vertically different from the plane containing printer and encoder.

This is possible by critically coordinating the magnetic encoding (1) and the thermal printing (3), in the sense that the magnetic encoding and the thermal printing share a common portion of the machine longitudinal dimension, both referring to the same alignment photocell (not represented).

In contrast, in the conventional positioning, the total machine longitudinal dimension is at least four times the length of a card. In fact one card length is reserved to the card feeder (CF), two card lengths are reserved to the thermal printing and one card length is reserved to the magnetic encoding.

Accordingly with the new general spacial disposition of the three elements of the invention, the total length of the machine is not over 3 times the card length, which represents a space saving of 25%

At the same time, and as shown in FIG. 3 the colour detector (2) is located in the space between the encoder (1) and thermal printer (3). The distance between the colour detector (2) and the thermal printer (3) must be critically equal to the maximum dimension (length) B (FIG. 3C) of the ribbon Panel, allowing (surprisingly) a precise ribbon synchronization under the printing head (TPH), without a further movement of the ribbon from the sensor alignment position to the printing position, controlled through a position sensor, like for instance an incremental encoder.

The positioning of the colour detector (2) with respect to the thermal printer (3) is shown in FIGS. 3 and 3C. By indicating with X2 the center of sensor (2) and with X3 the center of printer (3), the distance from X2 to X3 is characteristically just B i.e. the major dimension of the panel P of the colour ribbon R (FIG. 3B). In FIGS. 3 and 3B, RO1 and RO2 indicate the rollers of the ribbon bobbins.

As shown in the top portion of FIG. 1, the system of the invention comprises an Overall Processing block OP including a Central Processing Unit CPU controlling Driver D1 associated to the Magnetic Encoder (1), Driver D2 associated to the Color Sensor (2) and Driver D3 associated to the Thermal Printing Head (3). Said processing block OP controls the lower operating block OS.

It can be immediately anticipated that, according to an advantageous feature of the invention, all Drivers are implemented in Reprogrammable HW (Hardware) and fitted into Devices, well known with the name of Field Programmable Gate Array (FPGA), and particularly the ones based onto the SRAM (Static Random Access Memory) technology.

Returning to the Overall System OS of the invention (FIG. 1) it can be appreciated that the card C entering the machine operative block OS can follow three paths, namely:

a) Path 1: the card coming from the FEEDER (CF), enters through the line CF_1 the Magnetic Encoding (1) and through line C1_3 the Thermal Printing (3) arriving to the terminal CARD UNLOADER (CU)

b) Path 2: the card coming from the FEEDER (CF), enters through line CF_3 the Thermal Printing (3) bypassing the Magnetic Encoding (1) and through line C3_U arrives to said CARD UNLOADER (CU)

c) Path 3: the card coming from the FEEDER (CF), enters through line CF_1 the Magnetic Encoding (1) and through line C1_U arrives to said CARD UNLOADER (CU) without entering the Thermal Printing (3)

The Ribbon (R) from the Ribbon Feeder (RF) arrives through line RF_2 to Colour Detector (2) and through line R2_3 arrives to Printer (3) from which goes to the Ribbon Recovery (RR).

Figure 2:
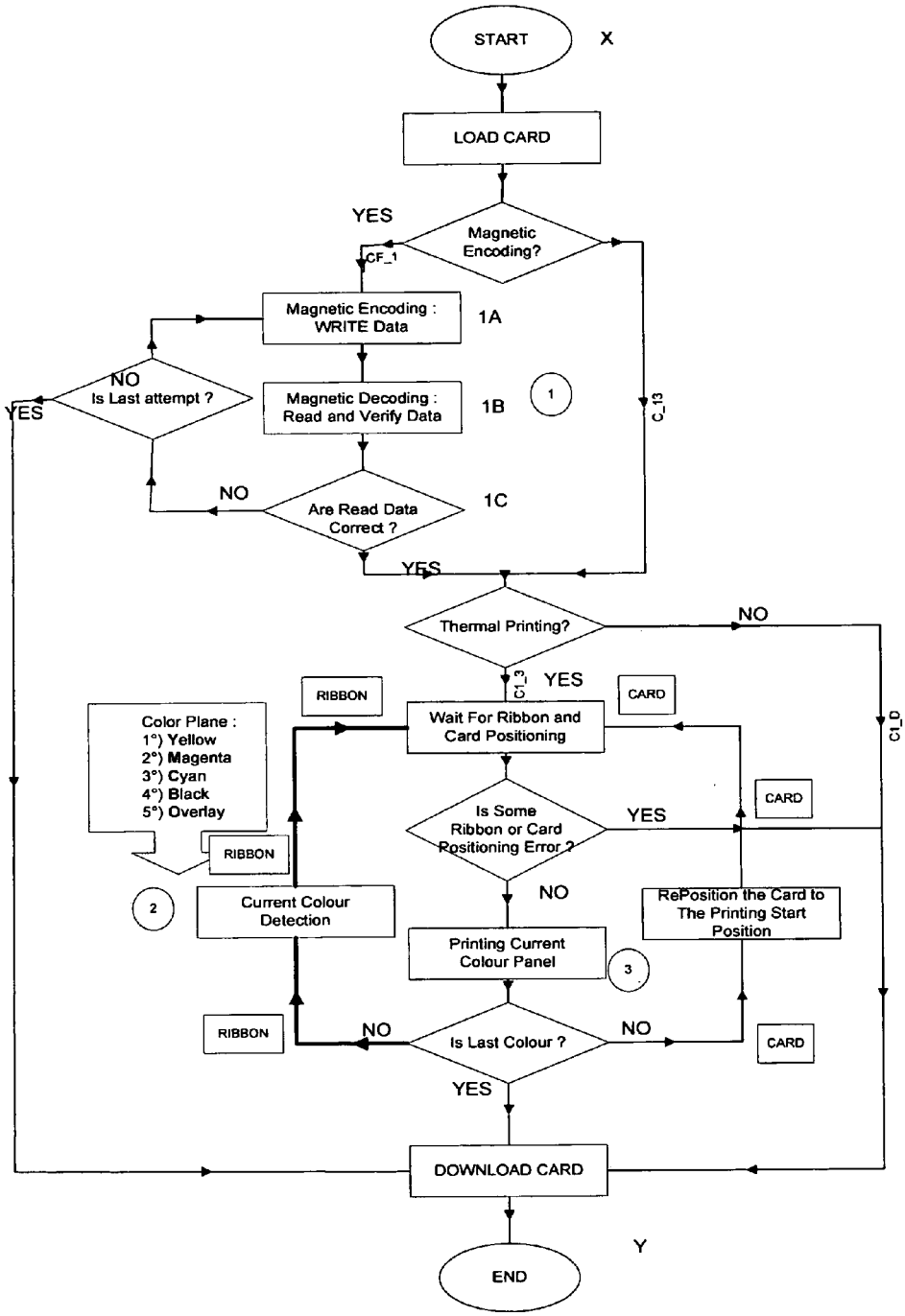
FIG. 2: is a flow chart of operative block OS.

FIG. 2 shows the Flow Chart of the two above treatments (flows of the card and of ribbon).

At the START point of the Process the Card C coming from the Card Feeder CF can follow two different paths, depending on the fact that it has to undergo the Magnetic Encoding (1) or not.

Path CF_1

Via path CF_1 the Card undergoes the phase corresponding to the Magnetic Data Encoding (1A) (Data are written on the tracks selected by the User), and immediately thereafter undergoes the Magnetic Data Decoding (1B) (The written data are Read and Verified); thereafter if the read data are correct in IC, the card is ready for the possible Thermal Printing (3). In case the verifying phase (1B) of the written data doesn't succeed, further attempts of Encoding (1A) and Decoding (1B) are attempted up to a predefined maximum number, after which it is decided that the card is defective and has to be ejected.

Path CF_3

When Magnetic Encoding is not required the card can directly and rapidly proceed to the Thermal Printing phase, bypassing thus the unnecessary encoding and enhancing the efficiency.

After the Magnetic Encoding two more paths are possible for the Card.

Path C1_3

Through path C1_3 the Card enters the Thermal Printing (3) process all together with the Colour Ribbon (R). The card processing and the Ribbon processing are synchronized at the beginning of each Colour Panel Printing, when the Card has to reach the Start of Printing Position and the Ribbon, under the control of the Colour Detector (2), has to reach the beginning of the next Colour Panel to be Printed.

When all the colour panels of the Ribbon have been Printed, the Card can reach the Unloader position (CU), through the C3_U path.

Path C1_U

Through the path C1_U, the card, after Magnetically Encoding (1), (a Thermal Printing phase being unnecessary), is directly discharged into the Unloader (CU).

As it can be appreciated also from the flow chart of FIG. 2, the system is advantageously flexible: indeed it allows to avoid printing not only of cards not to be printed but also of cards badly encoded, with not-negligible savings of ribbon, time and thermal energy. Similarly for the cards not to be encoded.

Reprogrammable HW Implementing the Process Drivers

The prior art in the electronic system implemented for the control of Plastic Cards Thermal Printers and/or Encoders, has as unique flexibility's element, the one related to the SW (Software) code executed by the Central Processing Unit. In those electronic systems, once the HW (Hardware) resources are defined, the only functional improvement can be obtained by working on the Execution Code.

Figure 4:
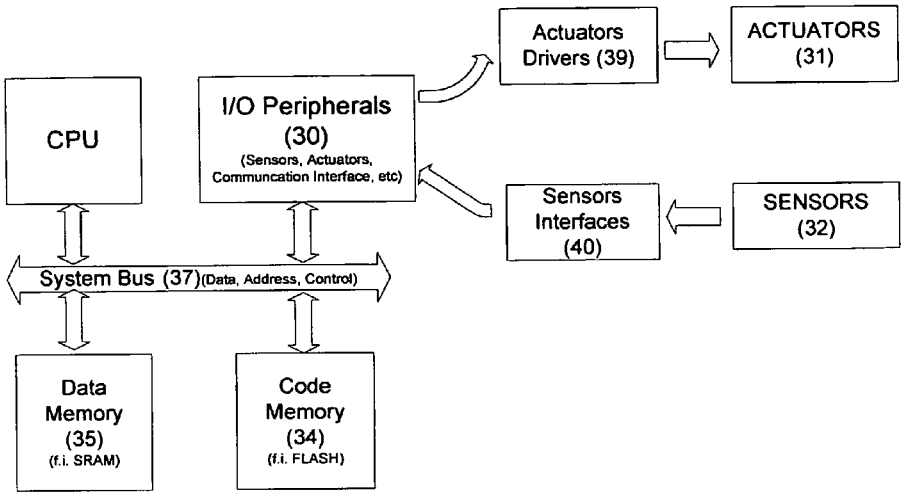
FIG. 4: shows a traditional architecture of an electronic board controlling a system like a card Printer and Encoder.

FIG. 4 represents the general structure of a traditional non reprogrammable HW in which the I/O (Input/Output) peripherals (interfacing to Actuators and Sensors) are defined by an appropriate configuration of standard non reconfigurable components (substantially known persè). Generally it comprises the classic Central Processing Unit CPU, a System Bus (37), Data Memory (35), Code Memory (34), I/O peripherals (30), acting on the Actuator Drivers (39) and receiving signals from Sensor (32) on the Sensor Interface (40).

This conventional architecture is knowingly unsuitable to give a reprogrammable HW: indeed it is absolutely lacking flexibility to allow functional upgrading or debugging.

Such a kind of architecture does not allow the possibility of adding, improving, or correcting the HW functionalities over time.

This aspect represents a great limitation in particular for the following reasons:

1) Higher development time of the electronic system;
2) The HW defects related to problems not considered during engineering phase can not be solved on the already produced boards;
3) Once in production it is no longer possible to implement further features or to improve the actual HW solutions.

An aspect of the present invention is that the structures of the overall system (OS) and of the Overall Processing (OP) allow the implementation of the HW technology based on the use of components called Field Programmable Gate Arrays (FPGA), whose HW configuration can be defined in the so called "In System Programming" (ISP).

Figure 5:
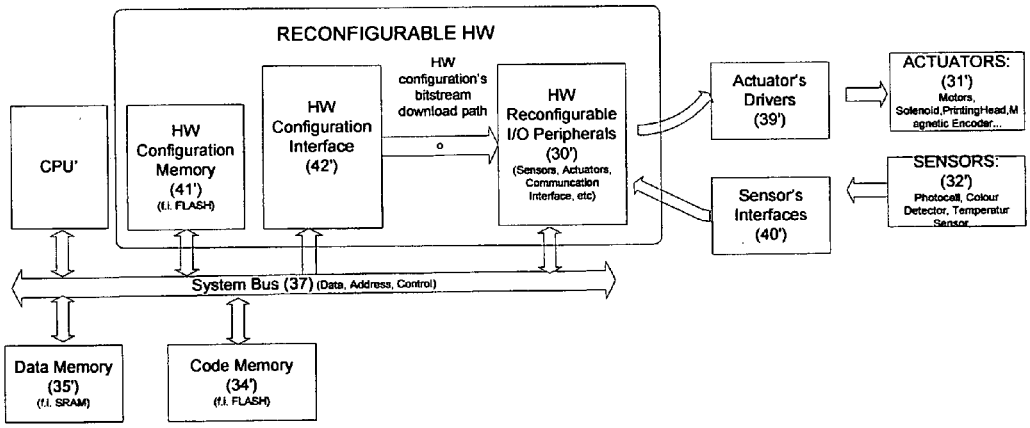
FIG. 5: shows the innovative architecture implemented in this invention, where the I/O (Input/Output) peripherals are mostly controlled by reprogrammable HW.

Such ISP configuration of the HW allows to configure the FPGA components under control of the Central Processing Unit, downloading via SW a bit-stream that can be previously stored into the system non volatile memory (41' in FIG. 5).

FIG. 5 represents the general structure of a reconfigurable HW, according to the invention, in which the I/O peripherals (30') (interfacing Actuators (31') through the appropriate Driver (39') and Sensors (32') trough the Sensor Interface (40')) consist now of components whose configuration can be downloaded by the Central Processing Unit (CPU) through an HW Configuration Interface (42'), reading the configuration file from a dedicated memory (Hardware Configuration Memory, 41').

Summarizing, the reprogrammable HW of the invention is obtained simply by replacing the standard I/O peripherals with In System Programmable and reconfigurable devices (Static RAM based FPGA), and introducing in the prior block diagram a configuration memory (41') and an appropriate interface between the FPGAs and the CPU.

The procedure to update the HW is composed of the following steps:

1) an appropriate function supplied by a BIOS (Bootstrap Initialization Operating System) of the Printer provides the possibility to update the HW configuration memory (41'), with the file corresponding to the new release of the HW functionalities.
2) At the initialization cycle, the CPU configures the reprogrammable HW (30') with the updated release present into the HW Configuration Memory (41'), through an appropriate interface (42').

The major advantages of the HW reconfigurability are:

a) shorter Time to Market of the new product;
b) capability of updating, improving and debugging the HW functionality also for the electronic boards already present into the market;
c) capability of implementing at a HW level, instead of a SW level, new functionalities with the purpose of freeing the CPU work of a certain number of tasks, so that it's possible to obtain an overall improvement of the system performances and Real-Time Process control of complex devices.

Accordingly a further advantage of the present invention, is the fact that the Overall Processing block (OP) has been based on the previously described technology, so that each critical operation is controlled by an HW Driver, implemented into SW reconfigurable FPGA.

What is really important to underline is that it is now possible to update the HW configuration of the drivers, also at the customer side, through a download operation that can happen using the standard connection port of the machine itself.

In the following paragraphs are described the single Driver Implementation, with more emphasis to the Color Sensor Control and the Thermal Energy Feeding for the monochromatic printing.

Colour Detection

Figure 6:
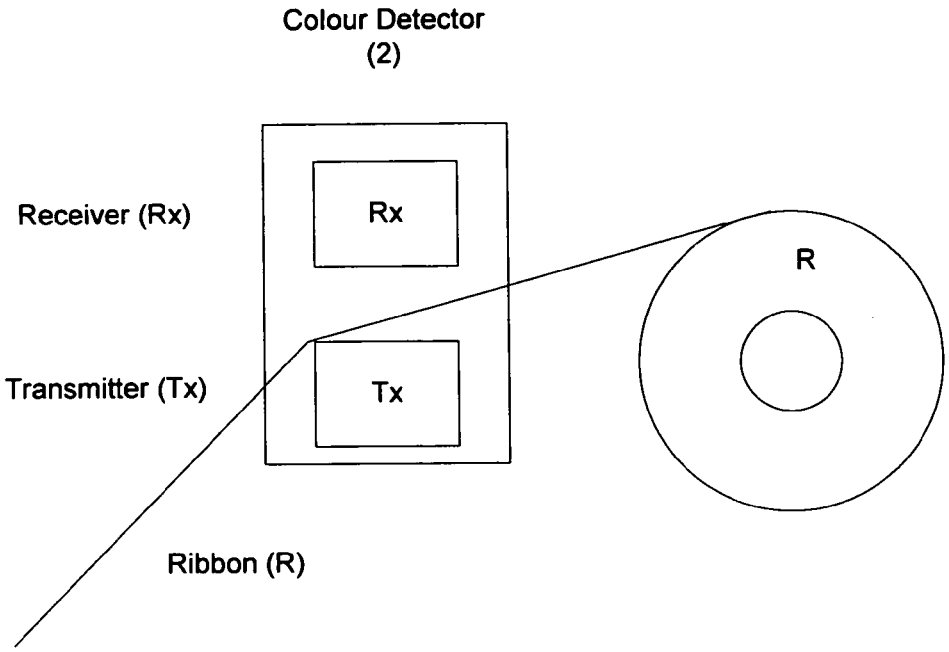
FIG. 6: is a schematic representation of the Colour Sensor according to a preferred embodiment o the invention.

Preferably the colour detector (2) structure is advantageously implemented as shown in FIG. 6.

The Ribbon (R), before undergoing the Thermal Printing (3), enters the Colour Detector (2), passing in the space between a transmitting unit (Tx) and a receiving unit (Rx). The recognition of the ribbon colour, happens by interpreting the information given by receiver (Rx), relative to the components of the emitted light that is able to pass the filtering action given by the presence of the ribbon R.

Figure 7:
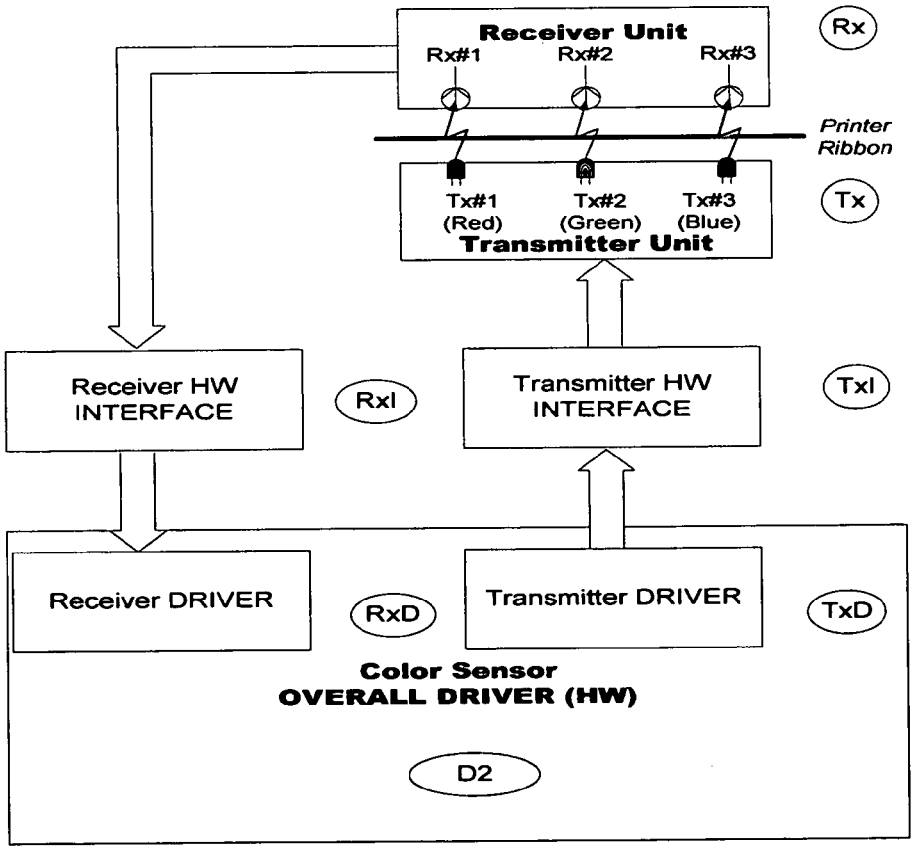
FIG. 7: is a block diagram of the control HW of the Colour Detector of FIG. 6

A preferred and advantageous embodiment of the Colour Detector(2) is described in FIG. 7.

As previously announced, the Colour Detector (2) is composed of a transmitter unit (Tx), a receiver unit (Rx), an HW interface towards the transmitter unit (Tx1), an HW interface towards the receiver unit (Rx1) and a driver (D2) that is internally divided into at least two sub-units, one controlling the Transmitter function (TxD) and the other controlling the Receiving function (RxD).

The Transmitter Unit (Tx) is composed of three LEDs (Light Emitting Diodes), respectively of colour Red (Tx#1), Green (Tx#2) and Blue (Tx#3).

Those LEDs are driven by power switches present into the Transmitter Interface, according to the control signals supplied by the transmitter driver (TxD).

The light intensity emitted by each LED is controlled through series trimmers, not represented, that are regulated through a calibration procedure using a particular calibration equipment, that are not described in the present document, as they can be considered persè known and requires no further details.

The Transmitter Driver (TxD) is composed by a Finite State Machine that is triggered by a periodic event to drive in sequence LEDs Tx#1, Tx#2, Tx#3, with an activation pulse, Tled, with a duration of 20 microseconds. Such activation time, Tied, has been determined as the characteristic response time of the photo-detectors.

The receiver unit (Rx) is composed by three equivalent large-band photo-detectors Rx#1, Rx#2, Rx#3, one for each transmitter, and mechanically faced to each relevant transmitter.

Figure 8:
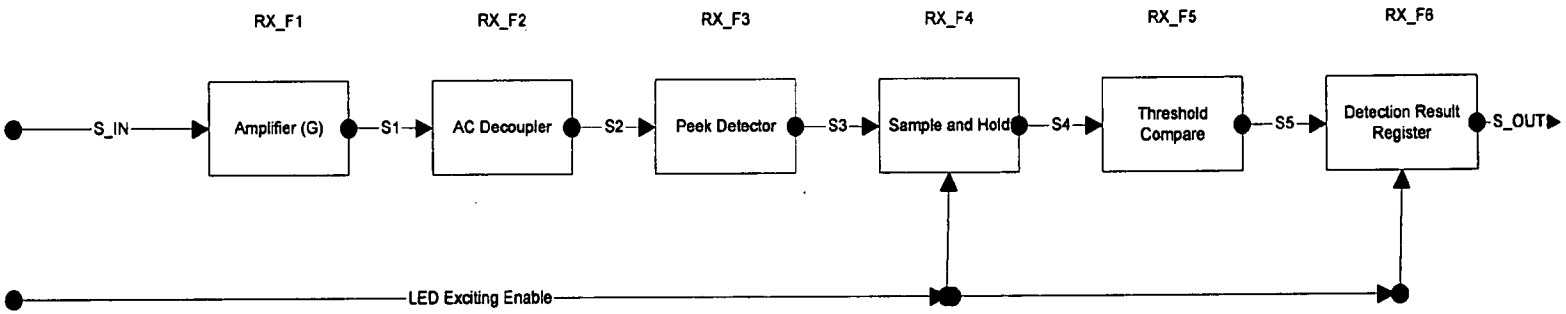
FIG. 8: is a block diagram of the HW implemented into the Receiver Interface for elaborating the output signal of the Receiver Unit, being such unit presented in FIG. 7

The receiver interface (RxI) acts as signal conditioning HW shown in the Block Diagram represented in FIG. 8.

The signal outgoing the Receiver Unit (RX), named S_IN, at first enters block RX_F1, a Gain Amplifier (G), to generate a signal SI which is more significant with respect to the power supply range.

S1 then enters the block RX_F2, an AC Decoupler, that filters the signal over the frequency of 10 KHz, obtaining a signal S2. S2 enters block RX_F3, which is a Peak detector, to obtain a signal S3 that store the maximum value reached by S2.

Then S3 enters block RX_F4 (a Sample-and-Hold Stage,) that samples S3 in the period corresponding to the transmitter activation, obtaining signal S4. Thereafter S4 is compared with a threshold voltage (in RX_F5) positioned in the middle of the power supply voltage range and the result is stored into a detection result register (in RX_F6) at the end of the transmitter activation pulse.

Both RX_F4 (Sample and Hold) and RXJF6 (Detection result Register) are fed with the LED enabling signal.

A further aspect of the present invention is the critical control and coordination of the activities implemented by the Transmitter and the Receiver Units, to constantly keep the Central Processing Unit informed about the colour status during ribbon movement.

This activity of control and coordination of the overall Colour Detector (2) is assigned to the HW reprogrammable Driver (D2), that is preferably implemented as a Finite State Machine (FSM)(persè known).

Figure 9:
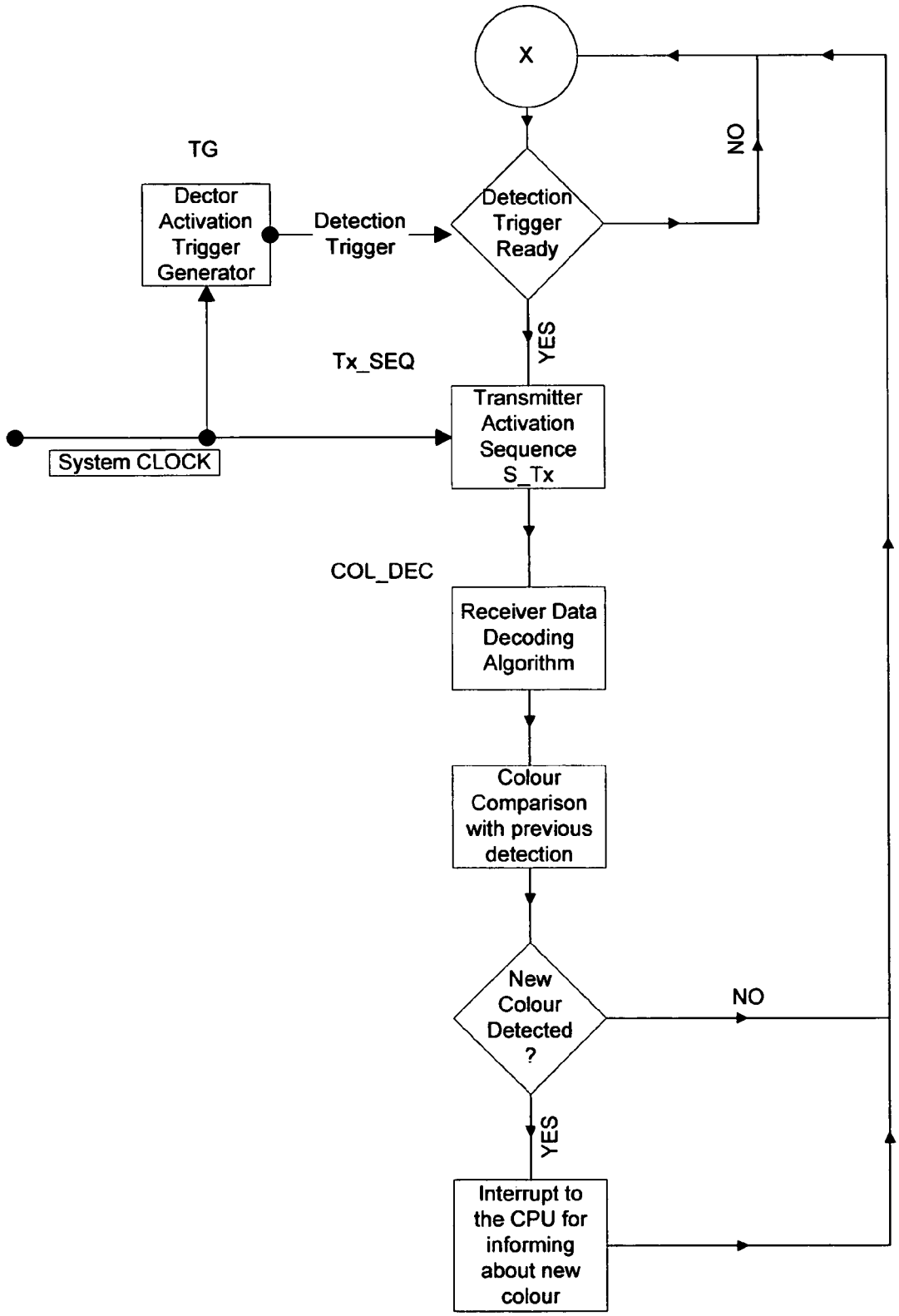
FIG. 9: is the flow-chart describing the Colour Detector behaviour described in FIG. 6

The behaviour of such Colour Detector-FSM can be described through an Hardware Description Language, like VHDL (Very high speed integrated circuit Hardware Description Language), simply translating the behavioural flow chart shown in FIG. 9.

FIG. 9 represents the behaviour of the Colour Detector Driver (D2) implemented to control the Colour Detector shown in FIG. 7.

Figures 9A, 9B:
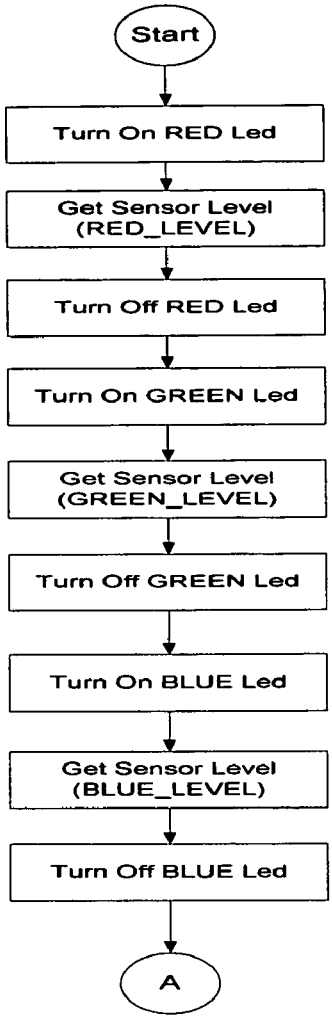
FIG. 9*a*: is the explosion of the Transmission Sequence represented in the Flow Chart of FIG. 9
FIG. 9*b*: is the decisional table used by the colour detector driver for interpreting the information obtained during the transmission sequence.

In particular, the colour detection is periodically activated by a Trigger Generator (TG) that starts the Transmitter Activation Sequence (TC_SEQ), described in detail by the flow chart represented in FIG. 9A.

Following the Transmitter Activation Sequence (Tx_SEQ) comes a decoding phase (COL_DEC) in which the information stored during the previous sequence are interpreted to determine the ribbon colour present under the sensor.

In FIG. 9A the Transmission Sequence is represented with more details.

In FIG. 9B describes the Colour Decoding Table used by the driver D2 to decode the information obtained during the Transmission Sequence TxSEQ.

Summarizing the ribbon colour information is obtained by a reprogrammable HW, that has a repetitive behaviour. This Driver, periodically activated, excites in sequence the three transmitting LEDs Tx#1, Tx#2 and Tx#3, and composing the three correspondent responses, obtains an information that is decoded using the Colour Detecting Table of FIG. 9B.

In conclusion, this section has presented an implementation of the preferred embodiment of the Colour Detector (2) Driver (D2) onto an HW reprogrammable device.

The behaviour of the control function of this driver, is well suited for an HW implementation, since it is a repetitive control cycle that can be easily described through a Finite State Machine.

Such FSM behaviour can be easily translated into such HW implementation using an Hardware Description Language.

The result of the implementation into an HW level of the Colour Detector Driver (D2) allows one to free the CPU of a hard duty, and at the same time allows one to have real time information of the ribbon colour.

Energy Feeding Control for a Thermal Printing Head

The core problem of a Thermal Card Printer is the heat control of the printing elements.

The thermal printing of plastic cards, uses the transfer of coloured pigments from a Ribbon (R) to the plastic card (C).

This ink transfer requires a flow of heating energy to the printing elements (DOTs), usually implemented as ceramic resistors, to carry the ink molecules to the separation temperature.

Once the transfer temperature is reached, it is needed to transfer to the DOT a further quantity of energy for modulating the quantity of pigment that it's needed to move from the ribbon to the card.

The device that allows the thermal transfer control, is a printing head (TPH in FIG. 3) in which the printing elements (DOTs) are realized through ceramic micro-resistors, ideally positioned on the straight line of contact, mediated by the ribbon, between the head and the card.

Figure 10:
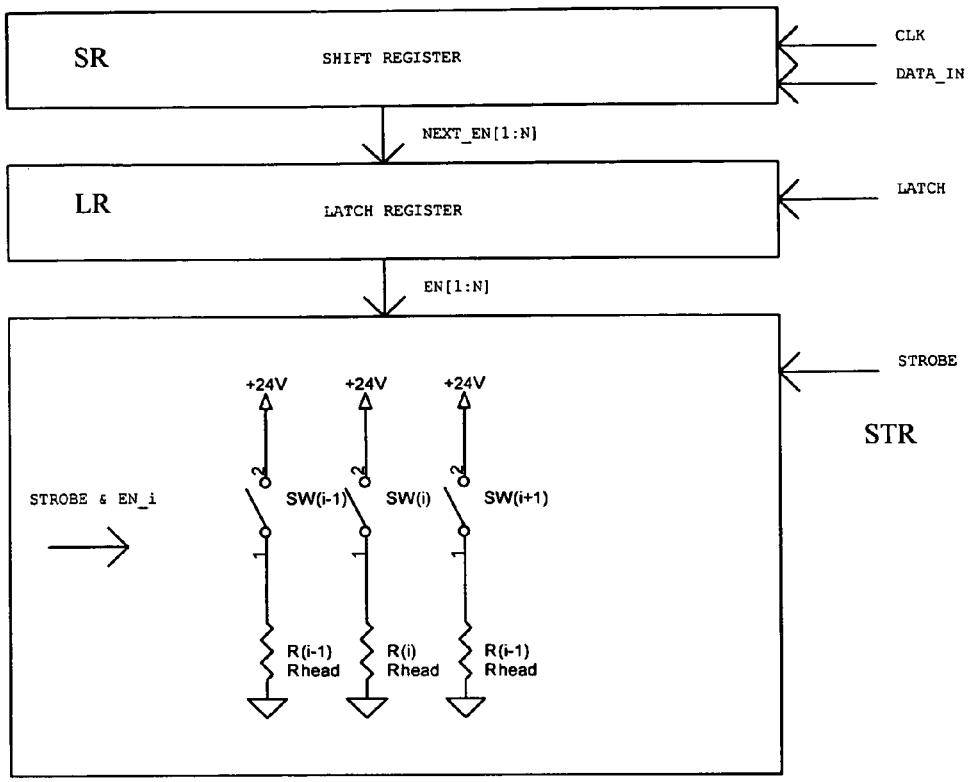
FIG. 10: is a block diagram of the Thermal Printing Head (TPH)

In FIG. 10 is shown the block diagram of the TPH functioning.

The TPH is composed of a shift-register (SR) on which is the data that defines the DOTs activation enable to the heating for the next printing. This insertion can happen while a previously inserted DOT line is running the heating cycle.

When the previous heating cycle is completed, the data present on the shift-register (SR) are loaded on a latch register (LR) whose outputs enable the power switches that feed the DOT.

When the control signal STROBE is activated, the DOTs that are enabled by the signals coming from the latch register (LR), are powered for the time of activation (Tstrobe) of the STROBE (STR), developing an energy of $$Ed=\{[(24V)\ 2/Rhead]*Tstrobe\}.$$

In an ideal case in which the printing elements were without thermal memory and without thermal interference (each thermally isolated), the calculation of the energy necessary to get the desired thermal state would be extremely simplified.

However, this simplification is not admissible when it's desired to get printings of excellent quality also in conditions of high speed, that is of a minimum delay between the printing of one line and of the following one.

A complete mathematical model of the thermal behaviour of the Dots, should consider the effects deriving from their printing history and the Energy contributions coming from all the neighboring heating elements.

A simplified, but effective, model considers the contributions of the first adjoining heating element, and the DOT history departing from the medium head temperature and taking into account the activity of each element just on the row before the present.

The heating control system, implemented in the present invention considers the non-ideality of the Printing Head, that are the DOT thermal memory and the thermal contribution that influences one dot printing area coming from the neighboring heating elements.

For simplification, the system will be here described as limited to the monochromatic printing and be named "Spacial and Temporal Convolution for the Dot energy feeding computation".

The Energy feeding for each printing line, corresponding to one image vertical row, is decomposed in four fundamental components, that are:

1. Local Preheating: it is an heating phase that is applied to all such Dots that in the present printing line must be lighted (in correspondence of a Black Pixel) and in the preceding line were out (White Pixel). This preheating is necessary for carrying the coolest Dots to the medium head temperature.
2. Global Preheating: it is an heating phase that is applied to all the Dots for carrying them to the thermal transfer
3. Printing Heating: it is an heating phase that is applied to all the Dots that must sustain the thermal transfer temperature, for the time necessary to transfer in all the printing area (whose dimension is, for a 300 DPI resolution, of 84 $\mu$m*84 $\mu$m) the ribbon ink,
4. Convolution Heating: it is an heating phase that is applied to those lighted Dot, for which at least one of the neighbours is off. This heating applies a further energy contribution equivalent to the energy that a lighted Dot transfers onto the area of interest of the adjoining Dot.

Figure 11:
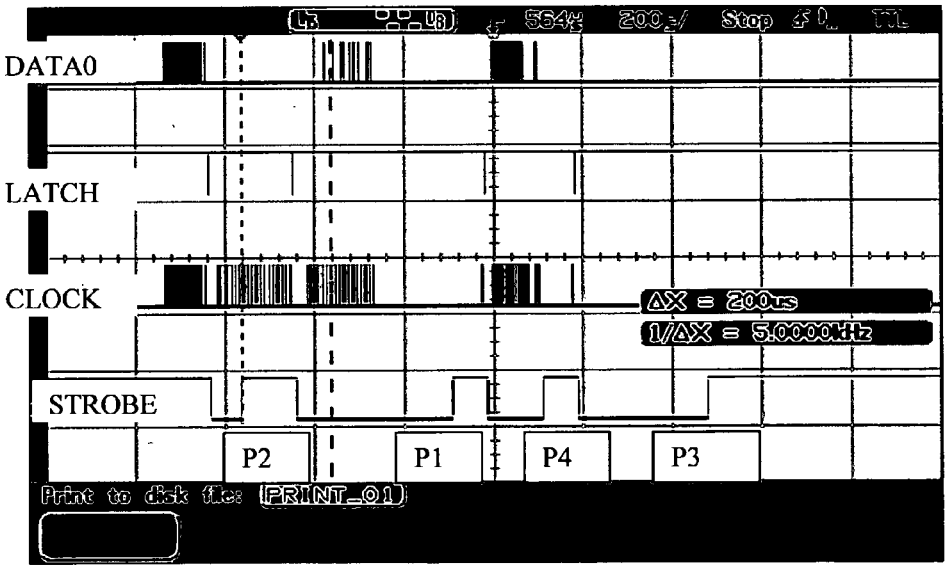
FIG. 11: is a representation of the control signals to the Printing Head.

FIG. 11 shows the control signals to the Printing Head (TPH), under such a control system.

In this figure are evident the DATA0 input signal, the serializing CLOCK, the LACTH signal and the STROBE signal.

DATA0 is serially inserted into the Shift-Register (SR), then the SR outputs are stored into the Latch Register (LR), and finally the STROBE signal activate when low, the Dot energizing phase.

The four heating phases are shown:

Phase 2 (P2) corresponds to the Global Preheating, phase 1 (P1) corresponds to the Local Preheating, Phase 4 (P4) is the Convolution Heating and Phase 3 (P3) is the Printing Heating.

This complex system has been developed into the HW Driver (D3) of the Thermal Printing (3).

Figure 12:
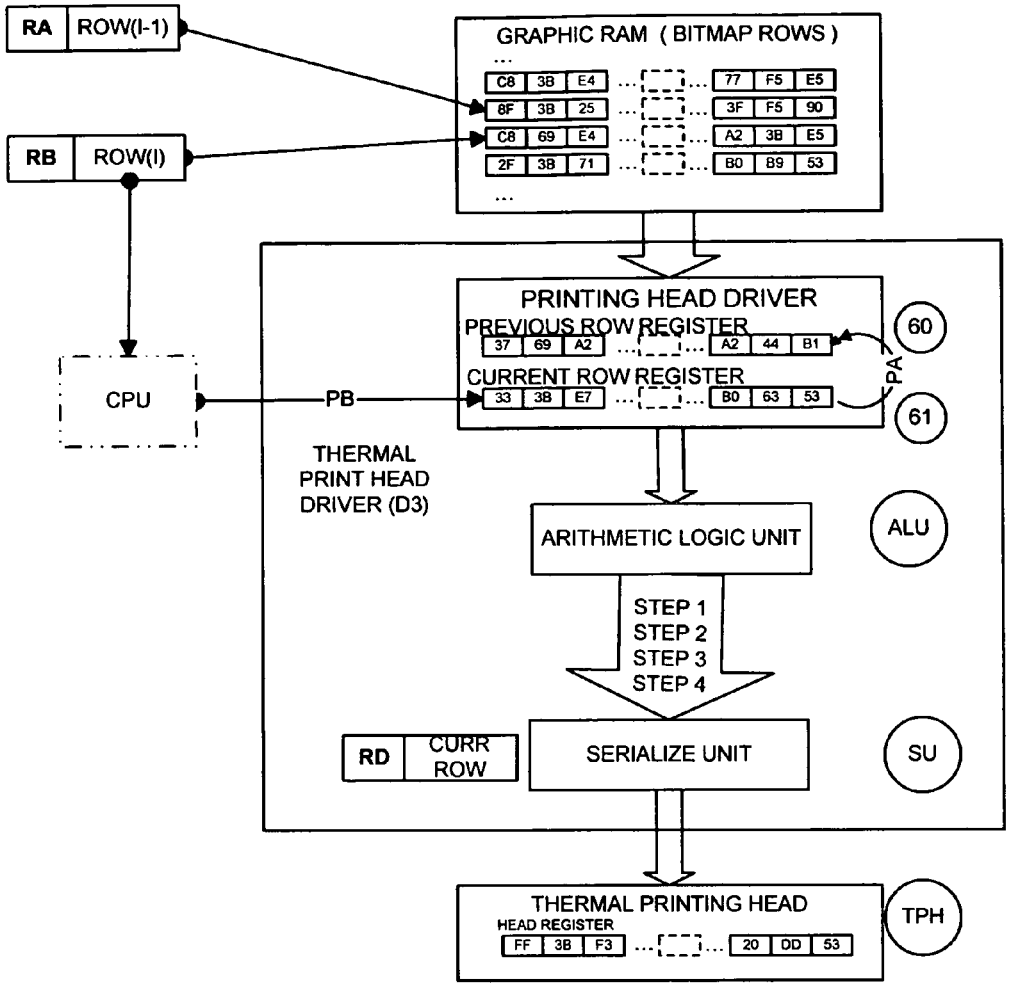
FIG. 12: is the block diagram of the HW Driver that pilot the Printing Head for the Energy feeding control

FIG. 12 shows the block diagram of the HW Driver (D3) that pilots the Printing Head for the Energy feeding control.

At each printing Row, corresponding to a image line or Bitmap row of a Graphic RAM, the previous line data, stored into the Current Row Register set (60), are shifted into the Previous Row Register set (61), during the phase PA, and the CPU (FIG. 1 ecc.) feeds the Current Row Register set (61) with the data corresponding to the current Image Line to Print during the phase PB.

The Arithmetic Logic Unit (ALU), computes the four data sequences to feed into the Thermal Printing Head, corresponding to the four Heating contributions previously described.

Each data sequence is fed into the TPH through a Serialize Unit (SU) that controls the TPH control signals, i.e. the Data, Clock and Latch.

Figure 13:
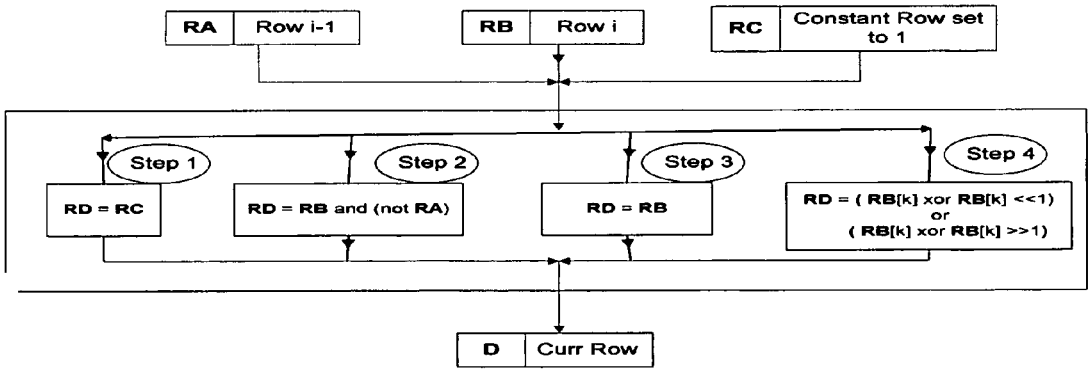
FIG. 13: is the Arithmetic Logic Unit computing the data-stream that must be transmitted to the Printing Head for performing the four Printing phases.

The ALU unit feeds the Output Shift Register of the Driver (D3) performing the computations described in FIG. 13.

In FIG. 13 the mathematical procedure for obtaining the four data stream to feed into the Thermal Print Head is shown.

In particular:

STEP 1 corresponds to the Global PreHeating phase, in which all Dots have to be energized. In this case the Thermal Print Head is fed with a constant row RC, composed by all ones.

STEP 2 corresponds to the Local PreHeating phase, in which it is necessary to activate the Dots that are lighted in the current row RB=Row (Row i), and were not lighted in the previous row RA=(Row i−1). In this case the Thermal Print Head is fed with a row RD, achieved with the following formula: RD=RB and (not RA).

STEP 3 corresponds to the Printing Heating phase, in which the current Row (RB=Row i) is transferred into the Thermal Printing Head (TPH) to be Printed.

STEP 4 corresponds to the Convolution Heating phase, in which it is necessary to activate the Dots that are lighted in the current Row (RB=Row i), that have at least one neighbour that is off.

In this case the Thermal Print Head is fed with a row RD, obtained with the following formula:

$$RD=(RB[k]\ xor\ RB[k]<<1)\ \text{or}\ (RB[k]\ xor\ RB[k]>>1)$$

After each step the Driver informs the CPU that the Head is ready for printing through an interrupt service routine, than the CPU pilots the STROBE signal to energize the selected Dots for the time required to each function to be performed.

In conclusion, in this paragraph an efficient system for the energy feeding of a thermal print head has been presented. This system considers the non idealities of the printing elements that are the thermal memory of each dot and the thermal interference that happens between neighboring dots.

This system for being efficiently implemented requires to demand a relevant part of the head control to an HW Driver.

An embodiment of such HW, that has been realized by means of a Field Programmable Gate Array, has been presented by describing its structure and basic working.

Once again the opportune system co-design, HW and SW, has allowed one to obtain an optimum trade-off between performance and printing quality, keeping a sufficient level of flexibility, so that this system is open to future improvements.

For illustrative clarity the invention has been described with particular reference to the embodiments represented in the accompanying drawings. It is obvious that all changes, alternatives, substitutions and the like to said embodiments which are in the reach of one skilled in the art are to be considered as falling within the scope and the spirit of the following claims.

What is claimed is:

1. A method for ribbon color detection, thermal printing and encoding a card such as a pre-paid, smart-, or chip-card, comprising the steps of:

magnetically encoding said card to obtain a magnetically encoded card;

thermal printing said magnetically encoded card; and detecting the color of a color ribbon, said magnetic encoding being carried out spatially upstream from said thermal printing, wherein said magnetic encoding is horizontally aligned and critically coordinated with said thermal printing, so that said encoding takes place at a distance from the printing less than a major dimension of said card, said color detection step taking place between the encoding and printing on a plane other than the plane of said aligned encoding and said printing, at a distance from the printing equal to the maximum dimension of a ribbon panel whereby a precise ribbon synchronization under a printing head is reached.

2. A method according to claim 1, characterized in that said magnetically encoding takes place under a first critical coordination between encoding and printing, and said detecting takes place under a second critical coordination between detection and thermal printing.

3. A method according to claim 2 in which said encoding is at a distance from a card feed, said distance being equal to said major dimension of said card.

4. A method according to claim 2 in which encoding and printing are positioned in the same plane (X_Y_ZO), containing the card path line, the detection position is in a plane (X_Y_Z\ where Z'>ZO) superposed to said plane of the aligned encoding and printing.

5. A method according to claim 4, in which said detection position is such to minimize both the (X-Y) distance between encoding and printing, and the height of the detection over said printing.

6. A method according to claim 1, in which the encoding-, printing- and detection-steps are each controlled by HW reprogramming.

7. A method according to claim 6, in which the thermal printing is controlled by controlling the thermal energy feed with the aid of a space-time convolution algorithm.

8. A method according to claim 7, in which the feed thermal energy is decomposed in a local and global preheatings, in a printing heating and a convolution heating.

9. A method according to claim 6, in which the reprogrammable HW is implemented by Field Programmable Gate Arrays, that can be reprogrammed using In System Programming technology.

10. A machine for ribbon color detection, thermal printing and encoding a card such as a pre-paid, smart-, or chip-card, comprising:

a magnetic encoder for magnetically encoding a card;

a thermal printer for thermal printing said card; and a color detector for detecting the color of a ribbon, said magnetic encoder being positioned spatially upstream from said thermal printer, said magnetic encoder being horizontally aligned with said thermal printer at a distance less than a major dimension of a card, said color detector being located between said magnetic encoder and said thermal printer on a plane other than the plane of said aligned encoder and said printer, at a distance from the printer equal to a maximum dimension of a ribbon panel whereby a precise ribbon synchronization under a printing head is reached.

11. A machine according to claim 10, in which the thermal printing is carried out by means of a thermal head, formed of ceramic resistive elements (so called DOTs), fed by thermal energy controlled with the aid of a space-time convolution algorithm whereby the thermal transfer to each DOT is decomposed in four main components: i) Local Pre-Heating to all DOTs which in the present Row are energized and in the prior row were unenergized whereby all DOTs are taken to a same mean Temperature; ii) Global Pre-heating applied to bring all DOTs to the Thermal equilibrium for transferring ink from the ribbon to a plastic card; iii) Printing heating; iv) convolution heating.

12. A machine according to claim 10, in which said encoder, printer, and detector include drivers implemented with reprogrammable HW technology.

13. A machine according to claim 12, in which use is made of In System Programmable (ISP) Field Programmable Arrays (FPGA).

14. A machine for ribbon color detection, thermal printing and encoding a card such as a pre-paid, smart-, or chip-card, comprising:

a magnetic encoder for encoding a card;

a thermal printer for thermal printing said card; and a color detector for detecting the color of a ribbon, said magnetic encoder being provided spatially upstream from said thermal printer, said magnetic encoder being horizontally aligned with said thermal printer on a first plane, at a distance less than a major dimension of a card, said color detector being located between said encoder and said printer, on a second plane which is different than said first plane, at a distance from the printer equal to a maximum dimension of a ribbon panel whereby a precise ribbon synchronization under a printing head is reached, wherein the thermal printing is carried out by a thermal head formed of ceramic resistive elements (so called DOTs), fed by thermal energy controlled with the aid of a space-time convolution algorithm whereby the thermal transfer to each DOT is decomposed in four main components: i) Local Pre-Heating to all DOTs which in the present Row are energized and in the prior row were unenergized whereby all DOTs are taken to a same mean Temperature; ii) Global Pre-heating applied to bring all DOTs to the Thermal equilibrium for transferring ink from the ribbon to the a plastic card; iii) Printing heating; iv) convolution heating, wherein said encoder, printer, and detector include drivers implemented with reprogrammable HW technology, wherein use is made of In System Programmable (ISP) Field Programmable Arrays (FPGA), and wherein the content of said FPGA elements is updated by an EPROM and a microprocessor interfaced to a communication bus.

* * * * *